US008159355B2

(12) United States Patent
Gerig et al.

(10) Patent No.: US 8,159,355 B2
(45) Date of Patent: Apr. 17, 2012

(54) MULTI-OPTION COMMUNICATION METHODS OF FAULT NOTIFICATION IN PET CONTAINMENT SYSTEMS

(75) Inventors: Duane A. Gerig, Fort Wayne, IN (US); Andrew F. Siska, Downers Grove, IL (US)

(73) Assignee: Radio Systems Corporation, Knoxville, TN (US)

( * ) Notice: Subject to any disclaimer, the term of this patent is extended or adjusted under 35 U.S.C. 154(b) by 859 days.

(21) Appl. No.: 11/686,385

(22) Filed: Mar. 15, 2007

(65) Prior Publication Data

US 2007/0229289 A1 Oct. 4, 2007

Related U.S. Application Data

(60) Provisional application No. 60/782,767, filed on Mar. 16, 2006.

(51) Int. Cl.
*G08B 23/00* (2006.01)

(52) U.S. Cl. ..... 340/573.3; 340/636.11; 340/691.6

(58) Field of Classification Search ..... 340/573.3, 340/573.1, 574, 571, 572.1, 636.11–636.17, 340/684, 686.6, 691.6
See application file for complete search history.

(56) References Cited

U.S. PATENT DOCUMENTS

| | | | | |
|---|---|---|---|---|
| 5,352,984 | A * | 10/1994 | Piesinger | 324/532 |
| 5,608,328 | A * | 3/1997 | Sanderson | 324/529 |
| 5,844,489 | A * | 12/1998 | Yarnall et al. | 340/573.3 |
| 6,215,314 | B1 * | 4/2001 | Frankewich, Jr. | 324/529 |
| 2001/0040508 | A1 * | 11/2001 | Janning et al. | 340/573.3 |
| 2003/0121480 | A1 * | 7/2003 | Grimsley et al. | 119/721 |
| 2005/0257748 | A1 * | 11/2005 | Kriesel et al. | 119/51.02 |
| 2005/0288007 | A1 * | 12/2005 | Benco et al. | 455/422.1 |

* cited by examiner

*Primary Examiner* — Daniel Previl
(74) *Attorney, Agent, or Firm* — Pitts & Lake, P.C.

(57) ABSTRACT

An animal confinement system including at least one transmitter, a loop antenna associated with each transmitter, a loop monitor associated with each loop antenna, a remote communication device and a communication device. The transmitter sends a signal to the loop antenna. The loop monitor senses at least one attribute of the signal. The communication device is communicatively connected with the loop monitor. The communication device communicates at least one attribute to the remote communication device.

20 Claims, 2 Drawing Sheets

MULTI-OPTION COMMUNICATION METHODS OF FAULT NOTIFICATION IN PET CONTAINMENT SYSTEMS

CROSS REFERENCE TO RELATED APPLICATIONS

This is a non-provisional application based upon U.S. provisional patent application Ser. No. 60/782,767, entitled "MULTI-OPTION COMMUNICATION METHODS OF FAULT NOTIFICATION IN PET CONTAINMENT SYSTEMS", filed Mar. 16, 2006.

BACKGROUND OF THE INVENTION

1. Field of the Invention

The present invention relates to communication methods of a monitoring device used in a pet containment system, and, more particularly, to communication methods of fault notification detected by a monitoring device by a pet containment systems.

2. Description of the Related Art

The Assignee of the present invention currently manufactures the Invisible Sentry System, which is designed to continuously monitor the containment signal that a containment transmitter sends a buried signal field wire. The current system includes a loop monitor module and a LCD display module. The loop monitor monitors the containment signal transmission to detect any changes in signal amplitude or signal frequency. These changes can indicate a break in the antenna wire, failure of the transmitter, or tampering with the transmitter settings has occurred after the loop monitor has been set up and calibrated to monitor the buried signal field wire. When the containment signal amplitude or frequency changes beyond predetermined limits, the loop monitor detects these changes. The loop monitor then conveys an alarm signal to the display module, with an audible alarm and a message being displayed on the LCD display module.

Animal containment systems include a transmitter that transmits a signal along the buried signal field wire, also known as a loop antenna to define a boundary for containment or the exclusion of an animal wearing the receiver collar. The receiver collar receives a signal from the loop antenna and the signal is processed to determine the proximity of the animal to the loop antenna. If the animal is within a predetermined distance of the loop antenna a stimulus is delivered to the animal to warn or alert the animal that it should avoid the boundary area.

What is needed in the art is a method and apparatus to provide for remote alert notification of any failures of the containment system.

SUMMARY OF THE INVENTION

The present invention provides multiple options for communication of fault notification in a pet containment system.

The invention in one form is directed to an animal confinement system including at least one transmitter, a loop antenna associated with each transmitter, a loop monitor associated with each loop antenna, a remote communication device and a communication device. The transmitter sends a signal to the loop antenna. The loop monitor senses at least one attribute of the signal. The communication device is communicatively connected with the loop monitor. The communication device communicates at least one attribute to the remote communication device.

An advantage of the present invention is that it provides for remote notification of either a failure or impending failure of a pet containment system.

Another advantage of the present invention is that it allows for diagnostics of the pet containment system from a remote location.

Yet another advantage of the present invention is that the pet containment system software can be remotely upgraded.

Still yet another advantage of the present invention is that it can monitor more than one loop antenna.

A further advantage of the present invention is that repair personnel can be dispatched to a location provided by the communication device.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
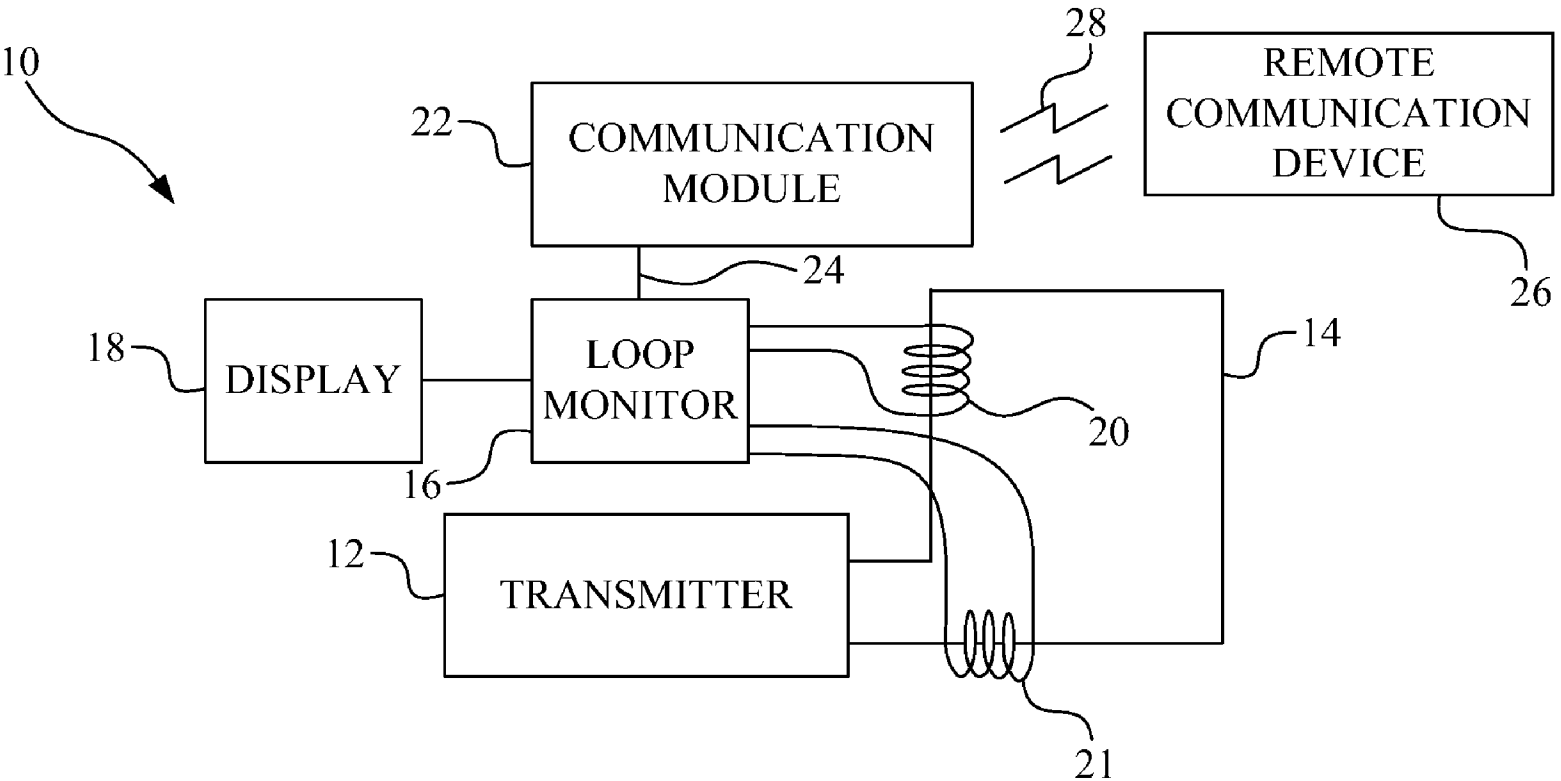
FIG. 1 is a schematicized view of one embodiment of a communication system of the present invention.
Figure 2:
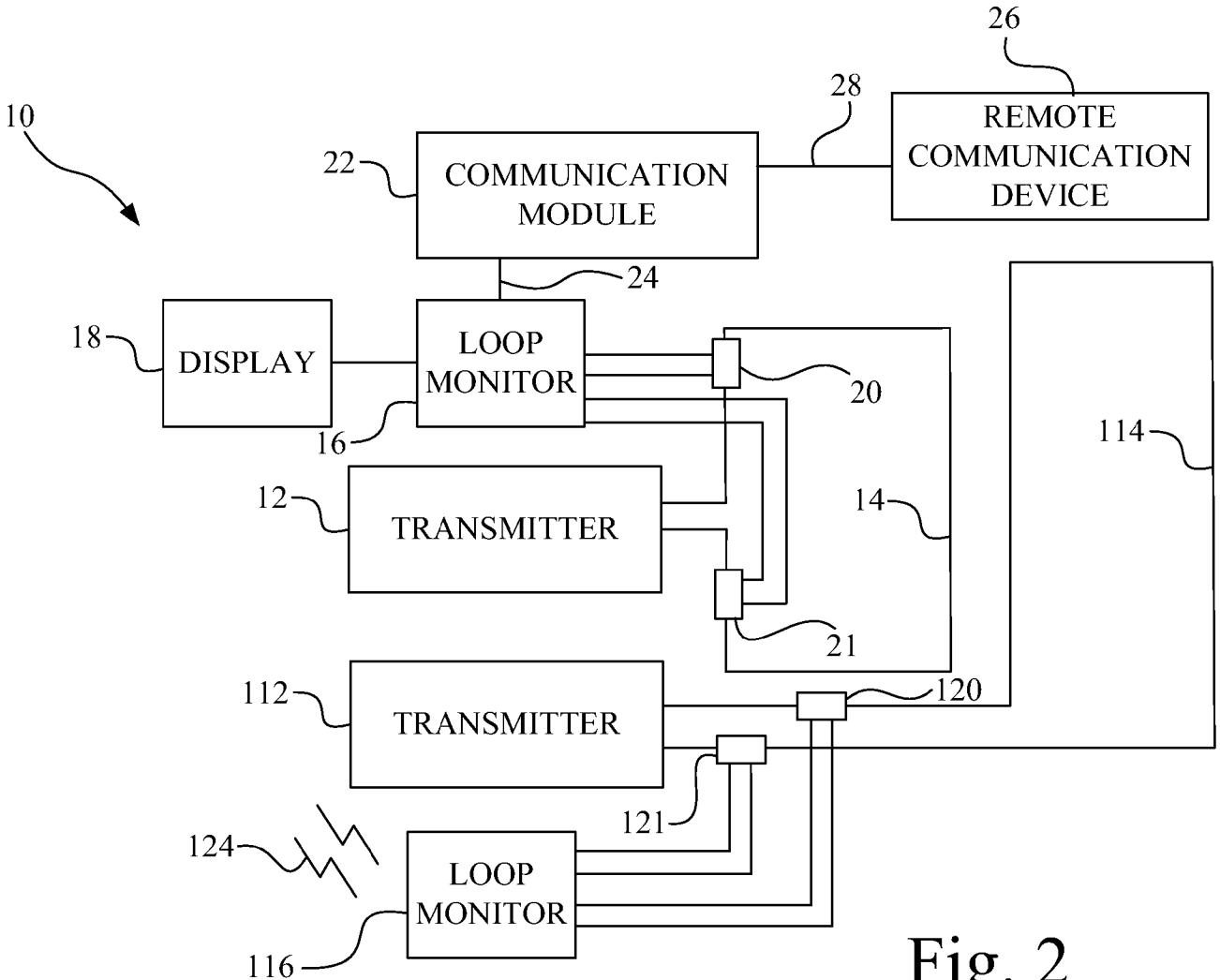
FIG. 2 is another schematicized view of another embodiment of a communication system of a pet containment apparatus of the present invention.

Referring now to the drawings, and more particularly to FIGS. 1 and 2, there is shown a pet containment system 10 including a transmitter 12, a loop antenna 14, a loop monitor 16, a display 18, signal coupling devices 20 and 21, a communications module 22, a communications link 24, a remote communications device 26 and a communications link 28. Transmitter 12 transmits a signal over loop antenna 14. The signal that is transmitted may be encoded and/or of a predetermined frequency and amplitude content. A receiver device worn on a collar by an animal receives a signal and provides a stimulation and/or alarm to alert the animal that it is approaching loop antenna 14 so as to either exclude the animal from the area defined by loop antenna 14 or to contain the animal within a border defined by loop 14. Transmitter 12 is also known as a signal generator 12.

Loop monitor 16, also known as an antenna monitor 16, monitors the signal transmitted over loop antenna 14 and monitors attributes of the signal to determine variations in the signal, which may indicate that transmitter 12 is failing or that loop antenna 14 has been compromised. When an attribute of a signal is detected to be out of predefined limits that information is conveyed to a display 18 and to communication module 22 by way of communication link 24. Signal coupling devices 20 and 21 may be antennas located proximate to loop antenna 14 or signal coupling devices 20 and 21 may be an inductive or a capacitive coupling, or even a direct electrical connection to loop 14, which is then connected to loop monitor 16. Signal coupling devices 20 and 21 may detect a signal imbalance emanating from loop antenna 14 to determine that damage has occurred to loop antenna 14.

The communication between communications module 22 and loop monitor 16 may be a hard wire connection 24 or a wireless communication link 24 that is relatively short having communication module 22 and loop monitor 16 relatively proximate to each other, such as being located on the same property perhaps in separate buildings at the owners residence or place of business. Communication module 22 transmits information to remote communication device 26 by way of communication link 28. Communications module 22 can be programmed with phone numbers to call in the event of a malfunction of pet containment system 10. Additionally, communication module 22 can facilitate troubleshooting by supplying information which may include module ID numbers, serial numbers, failure mode of system 10, user identification, the physical location of system 10 among other information that is communicated from communications module 22 to remote communication device 26. Communications module 22 can have a USB port for programming communications module 22 so that it can contain such information as the user identification, physical location and phone numbers to call in the event of failure or impending failure of system 10.

Communications link 28 may be a telephone landline 28, a radio frequency link 28, or other wireless links, an internet link 28, an Ethernet link 28 or a voice over IP link 28.

Remote communication device 26 may be a telephone 26, a cell phone 26, a computer terminal 26, a personal digital assistant (PDA) 26 or other communication device. Communications module 22 has security access features that provide authorized users the ability to communicate thereto by way of remote communication device 26. After the access authentication is completed information can be downloaded to system 10 by way of communications module 22 such as software upgrade to system 10 or troubleshooting of system 10 can be undertaken. For example, if the signal attribute detected by loop monitor 16 indicates a high likelihood that loop antenna 14 has been compromised, then repair personnel can be dispatched based upon the location and with the tools to fix loop antenna 14.

As shown in FIG. 2, a transmitter 112 transmits a signal on loop antenna 114 and the signal is detected by loop monitor 116 by way of signal coupling devices 120 and 121. Loop monitor 116 communicates to communication module 22 by way of communication link 124, which is similar to communication link 24. Communications module 22 then transmits information regarding more than one loop antenna and transmitter to remote communication device 26. Although not shown, further links can exist between communications module 22 and transmitters 12 and 112 to allow other troubleshooting features and software upgrades thereto to be performed remotely. These links have been omitted in the figures for the sake of clarity.

Communication links 24 and 124 can consist of a master/slave relationship respectively between communications module 22 and loop monitors 16 and 116. If link 24 or 124 is a radio frequency link then during system installation, communications module 22 will act as the master and will scan all communication channel frequencies to determine which frequency channel is the clearest for communication link 24 and 124. Communications module 22 then selects the optimal clear channel as the system communication frequency channel and will communicate this information to loop monitors 16 and 116. The communication channel may be the same or different for loop monitors 16 and 116.

The present invention utilizes several notification techniques to notify the user of a system problem. The user will be notified in the event of the occurrence of a containment wire break of loop antenna 14 or 114, a signal reduction or increase of predetermined levels or a loss of the communication link between loop monitor 16 or 116 and communications module 22. The present invention allows the user and/or others, such as a repair company, to receive the fault notification message and to correct the problem with containment system 10 regardless of their location to the installation. The message transmitted can include the loop monitor identification number, the failure that has been identified and the identification of the user and/or location of the installation. Further instructions may be communicated automatically by communications module 22, such as the owners desire for intervention by a third party, such as a message that if degradation of the system is detected between the hours of 11 pm and 6 am please delay the service call until normal business hours of the following day.

Communication link 28 may be a landline phone communication link 28. Communication module 22 can interface with a standard telephone network. Upon an alarm condition, communications module 22 would dial the phone number or numbers selected by the user to send the alert to the user, a qualified installation and repair service or other predetermined phone numbers. Communications module 22 can be configured to function simply as an outgoing messaging device or it may also be configured to receive phone calls for the purpose of troubleshooting systems faults and upgrading communication module 22, loop monitors 16 or 116 and/or transmitters 12 or 112. In a like manner, remote communication device 26 may be a cellular phone with communication link 28 being the cellular phone communication link. Additionally, voice over IP can be utilized to allow an interface of system 10 by the user or service provider.

Communications link 28 may be an internet communications link 28 that interfaces with the internet by way of a direct wired Ethernet connection or by a wireless broadband LAN. Upon an alarm condition communications module 22 sends an alarm message to the user, a qualified installation and repair service, or other predetermined internet accessible accounts. Additionally, upon installation and setup, the service provider would log the IP address of the communication module 22. This allows the service provider to initiate communications between the service provider and communication module 22 for the purpose of troubleshooting system faults and upgrading elements of system 10.

Communications module 22 interfaces with and provides a signal to a security system, such as building security and/or fire system, which in turn contacts an appropriate individual or entity directly or through a monitoring device. Also, optionally, the security system can communicate with communications module 22, so that the functioning of system 10 can be altered based upon a security breach and/or fire that is detected by the security system, not shown.

Communications module 22 may use a numeric encryption and decryption process in the programming and usage of the phone number or IP addresses. This is instituted so that only authorized services provider are capable of changing or modifying the alarm notification contact information or the functioning of system 10.

Advantageously, the present invention provides significant flexibility with notification of system problems in an animal containment system. Additionally, system upgrades to system 10 can be carried out on a subscription and/or as needed basis by a remote provider.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An animal confinement system comprising:

a transmitter producing a confinement signal receivable by a receiver unit worn by an animal;

a loop antenna in electrical communication with said transmitter, said transmitter sending a confinement signal on said loop antenna;

a loop monitor in electrical communication with said loop antenna through a first coupling device and a second coupling device respectively provided to different portions of said loop antenna, said loop monitor sensing at least one attribute of said confinement signal and detecting variations of said at least one attribute from a predefined limit indicating the operational integrity of at least one of said transmitter and said loop antenna; and a communication device communicatively connected with said loop monitor, said communication device communicating information about the operational integrity to a remote communication device.

2. The electronic animal confinement system of claim 1, wherein said first and/or second coupling devices are directly electrically connected to said loop antenna.

3. The electronic animal confinement system of claim 1, wherein said first and/or second coupling devices are inductively connected to said loop antenna.

4. The electronic animal confinement system of claim 1, wherein said operational integrity of said transmitter and said loop antenna is determined by monitoring for a signal imbalance between said broadcasted signal and said confinement signal.

5. The electronic animal confinement system of claim 1, wherein said confinement signal includes a selected attribute, said operational integrity of said transmitter and said loop antenna is determined by monitoring when said selected attribute of said containment signal deviates from a predefined limit.

6. An animal containment system, comprising:

an antenna for defining a containment area;

a signal generator coupled to said antenna, said signal generator sending a containment signal by way of said antenna;

an antenna monitor, in electrical communication with said antenna through a first coupling device and a second coupling device respectively provided to different portions of said antenna, detecting a selected attribute of said containment signal and monitoring said selected attribute for variations in said containment signal that indicate the operational integrity of said transmitter and said antenna; and a communication device in electrical communication with said antenna monitor and configured to transmit information about said operational integrity to a remote communication device.

7. The animal containment system of claim 6, wherein the remote communication device is one of a computer, a cell phone, a telephone and a personal digital assistant (PDA).

8. The animal containment system of claim 6, wherein said communication device transmits an address of a location of the animal confinement system.

9. The animal containment system of claim 8, wherein said communication device transmits at least one fault designation of the animal confinement system.

10. The animal containment system of claim 6, further comprising a communication device communicatively coupled to said antenna monitor, said remote communication device and said communication device co-act to update software in at least one of said communication device, said antenna monitor and said signal generator.

11. A method of monitoring an animal containment system, comprising the steps of:

transmitting a containment signal on a loop antenna;

sensing, through a first coupling device and a second coupling device respectively provided to different portions of said loop antenna, a selected attribute of said containment signal, and variations in said selected attribute in said containment signal that indicate the operational integrity of said transmitter and said loop antenna; and communicating information about the operational integrity to a remote device.

12. The method of claim 11, wherein said attribute includes at least one fault indicator of the animal containment system.

13. The method of claim 11, further comprising the step of communicating a software update to a loop antenna monitor, said loop antenna monitor monitoring said containment signal.

14. The method of claim 11, further comprising the step of communicating a location of the animal containment system to said remote device.

15. The method of claim 11, further comprising the step of sending a command from said remote device to a loop antenna monitor, said loop antenna monitor monitoring said containment signal.

16. An animal containment system communicating with a remote device, said animal containment system comprising:

a transmitter producing a containment signal receivable by a receiver unit worn by an animal;

a loop antenna in electrical communication with said transmitter for carrying said containment signal, said loop antenna comprising a first end and a second end;

a first coupling device in communication with said loop antenna proximate to said loop antenna first end, said first coupling device producing a first output corresponding to said containment signal at said loop antenna first end;

a second coupling device in communication with said loop antenna proximate to said loop antenna first end, said second coupling device producing a first output corresponding to said containment signal at said loop antenna second end;

a loop monitor electrically connected to said first coupling device and said second coupling device, said loop monitor determining the operational integrity of said transmitter and said loop antenna based on variations in said first output and said second output, indicating the operational integrity of said transmitter and said loop antenna; and a communication device in communication with said loop monitor, said communication device communicating information about the operational integrity of said transmitter and said loop antenna to a remote communication device.

17. The electronic animal containment system of claim 16, wherein said first coupling device and said second coupling device are directly electrically connected to said loop antenna.

18. The electronic animal containment system of claim 16, wherein said first coupling device and said second coupling device are inductively connected to said loop antenna.

19. The electronic animal containment system of claim 16, wherein said loop monitor determines the operational integrity of said transmitter and said loop antenna by monitoring for a signal imbalance between said first output and said second output.

20. The electronic animal containment system of claim 16, wherein said first output and said second output each correspond to a selected attribute of said containment signal, said loop monitor determines the operational integrity of said transmitter and said loop antenna by monitoring when said selected attribute of said containment signal deviates from a predefined limit.

* * * * *